US011703049B2

(12) United States Patent
Schaefer et al.

(10) Patent No.: US 11,703,049 B2
(45) **Date of Patent: *Jul. 18, 2023**

(54) GEROTOR PUMP WITH PRESSURE EQUALIZATION

(71) Applicant: Hanon Systems Bad Homburg GmbH, Bad Homburg V. D. Höhe (DE)

(72) Inventors: Tilo Schaefer, Daubach (DE); Uwe Becker, Butzbach (DE); Bernd Denfeld, Bad Homburg (DE)

(73) Assignee: Hanon Systems Bad Homburg GmbH, Bad Homburg V. D. Höhe (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/865,796

(22) Filed: Jul. 15, 2022

(65) Prior Publication Data

US 2022/0349401 A1 Nov. 3, 2022

Related U.S. Application Data

(62) Division of application No. 16/570,128, filed on Sep. 13, 2019, now Pat. No. 11,428,221.

(30) Foreign Application Priority Data

Sep. 14, 2018 (DE) ..... 102018215713.8
Jan. 17, 2019 (DE) ..... 102019200560.8

(51) Int. Cl.
*F04C 2/10* (2006.01)
*F04C 29/04* (2006.01)
*F04C 15/00* (2006.01)

(52) U.S. Cl.
CPC ..... *F04C 2/102* (2013.01); *F04C 15/0046* (2013.01); *F04C 15/0096* (2013.01); *F04C 29/04* (2013.01); *F04C 29/047* (2013.01)

(58) Field of Classification Search
CPC ..... F04C 2/102; F04C 15/0046; F04C 29/04; F04C 29/047; F04C 15/0096; F04C 11/008
See application file for complete search history.

(56) References Cited

U.S. PATENT DOCUMENTS 2,693,313 A 11/1954 McAdam
2,871,793 A 2/1959 Michie et al.
(Continued)

FOREIGN PATENT DOCUMENTS

CN 86105344 A 4/1987
CN 1734093 A 2/2006
(Continued)

OTHER PUBLICATIONS

Office Action regarding Chinese Patent Application No. 201910870830.2, dated Mar. 24, 2021.
(Continued)

*Primary Examiner* — Mary Davis
(74) *Attorney, Agent, or Firm* — Harness, Dickey & Pierce, P.L.C.

(57) ABSTRACT

A gerotor pump having an inner rotor and an outer rotor, which is also the rotor of an electric drive, having a housing and a flange which closes the housing with the motor compartment, the rotor being arranged on a shaft and sealing against the flange at a gap, wherein, in addition to the gap, there is at least one device with which at least a partial pressure compensation takes place between the suction region of the gerotor pump and the motor compartment of the gerotor pump.

4 Claims, 5 Drawing Sheets

(56) References Cited

U.S. PATENT DOCUMENTS

Figure 1:
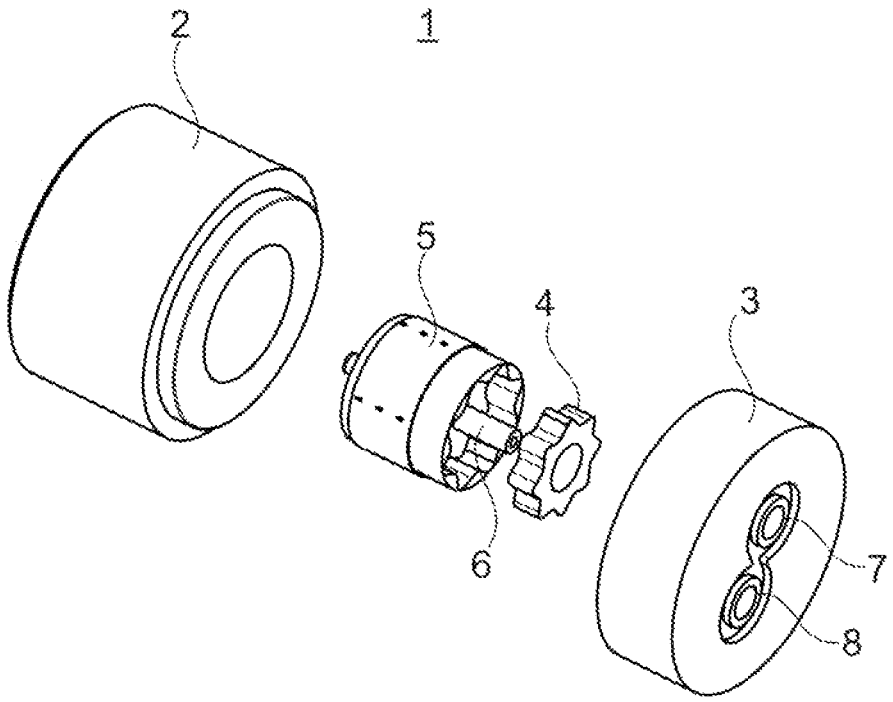

| | | | | |
|---|---|---|---|---|
| 7,381,036 | B2 | 6/2008 | Hundt et al. | |
| 8,038,423 | B2 | 10/2011 | Nakayoshi | |
| 8,632,321 | B2 | 1/2014 | Hadar et al. | |
| 11,428,221 | B2 * | 8/2022 | Schaefer | F04C 11/008 |
| 2012/0164009 | A1 | 6/2012 | Sakata | |

FOREIGN PATENT DOCUMENTS

| | | | |
|---|---|---|---|
| CN | 101260881 | A | 9/2008 |
| CN | 102472271 | A | 5/2012 |
| CN | 103443460 | A | 12/2013 |
| CN | 206386454 | U | 8/2017 |
| EP | 3957823 | A1 * | 2/2022 |

OTHER PUBLICATIONS

Office Action regarding Chinese Patent Application No. 201910870830.2, dated Nov. 19, 2021.

Office Action regarding Chinese Patent Application No. 201910870830.2, dated Mar. 7, 2022.

* cited by examiner

GEROTOR PUMP WITH PRESSURE EQUALIZATION

CROSS-REFERENCE TO RELATED APPLICATIONS

This application is a divisional filing of U.S. application Ser. No. 16/570,128, filed Sep. 13, 2019, which claims the benefit and priority of German Application Serial No. 1020192005608, filed Jan. 17, 2019 and German Application Serial No. 1020182157138, filed Sep. 14, 2018. The entire disclosures of each of the above applications are incorporated herein by reference.

FIELD

The disclosure relates to a gerotor pump having an inner rotor and an outer rotor, which is also the rotor of an electric drive, having a housing and a flange which closes the housing with the motor compartment, the rotor being arranged on a shaft and sealing against the flange at a gap.

The disclosure also relates to a method for producing a pressure compensation in a gerotor pump.

BACKGROUND

DE 10 2018 202 150, which has not yet been published, discloses a gerotor pump which has a diaphragm, and the leak-tightness of a gerotor pump with a pump working compartment, in which an inner rotor and an outer rotor are rotatably arranged and which is delimited by a housing cover, is improved by means of a pressure diaphragm.

In the specific case of such a highly integrated gerotor pump in which an electrical rotor and pump rotor are structurally combined, axial forces arise which are accommodated by an axial bearing on that side of the shaft which is situated opposite the gerotor pump. At the same time, a gap arises between rotor and side plate owing to the displacement of the rotor toward said axial bearing. In transmissions where such pumps are used, pressure peaks are observed, which can lead to component damage.

The movement generated by the axial forces causes mechanical friction in the axial bearing, and leakage in the gap between rotor and side plate.

Pressure peaks in the transmission must be accommodated, such that components must be designed to be highly overdimensioned.

The international laid-open application WO 2016/096755 A1 has disclosed a toothed ring pump with a housing. Within the housing, at the edge of a housing opening of a housing main body, a side plate which is extended through by a motor shaft is arranged fixedly with respect to the housing. Said side plate, which is preferably rigid, lies at the edge or at the outer circumference in a ring-shaped indentation of the housing main body. The rigid side plate has a circular-arc-shaped passage opening which extends over a circumferential portion. A flexible pressure-exerting plate, also referred to as diaphragm, is inserted into the housing between said side plate and the housing cover. Said pressure-exerting plate, which is preferably circular, is clamped by way of the outer edge thereof between the housing main body and the housing cover at the opening or edge side, and is thus likewise held fixedly with respect to the housing. By means of the flexible pressure-exerting plate, it is the case in particular that temperature-induced housing or pump part expansions are reduced and/or compensated.

These gerotor pumps operate with two side plates, between which the outer and inner rotor are guided with pressure compensation. This gives rise to a bearing region between the hydraulic pump rotor and electrical rotor of the drive motor, which increases installation space and production costs.

SUMMARY

It is an object of the disclosure to create an electrically driven gerotor pump in the case of which the pressure difference between motor compartment and pressure region is optimized in order to minimize leakages and axial forces.

The object is achieved by means of a gerotor pump having an inner rotor and an outer rotor, which is also the rotor of an electric drive, having a housing and a flange which closes the housing with the motor compartment, the rotor being arranged on a shaft and sealing against the flange at a gap, wherein, in addition to the gap, there is at least one device with which at least a partial pressure compensation takes place between the suction region of the gerotor pump and the motor compartment of the gerotor pump.

By means of a targeted build-up of pressure in the otherwise unpressurized motor compartment of the gerotor pump, the axial bearing of the gerotor pump is relieved of load, whereby the friction thereof decreases, and the gap between rotor and flange is compressed, whereby leakage decreases.

The inflow to said compartment is caused by the leakage in said gap itself, that is to say a greater inflow gives rise to more internal pressure and thus an improved sealing action, which, in terms of closed-loop control technology, equates to negative feedback.

The reduction of pressure peaks, or the extinguishing thereof, relieves other components of loads, such as in particular pressure sensors, the accuracy of which can thus also be improved.

In one advantageous embodiment, the device is a connection between the motor compartment and the suction region, the connection being provided in the flange.

It is particularly advantageous if the device consists of a cavity in the shaft and connections between the motor compartment and the cavity of the shaft and the cavity of the shaft to the suction region.

The flow through the motor compartment of the gerotor pump, which has come about through the cavity in the shaft, has the secondary effect that heat losses of electric motor and electronics are dissipated by the flow that is generated.

It is advantageous if the cavity in the shaft has a taper which serves as a throttle. In this way, the intermediate pressure level in the motor compartment can be set more effectively.

It is also an advantageous embodiment if the device consists of a cavity in the shaft and connections between the motor compartment and cavity of the shaft and cavity of the shaft to an eccentric bearing of the gerotor pump.

In this embodiment, not only is the flow through the motor compartment advantageous for the discharge of the heat losses of the electric motor, but the throughflow also serves for improving the supply to the eccentric bearing.

In all embodiments, it is advantageous if at least one of the connections has a reduction in cross-section which serves as a throttle.

In this way, the intermediate pressure and the magnitude of the throughflow can be set more effectively.

The object is furthermore achieved by means of a method for producing a pressure compensation in a gerotor pump, wherein an inflow of pressurized medium takes place through the gap into the motor compartment of the gerotor pump and at least one connection between the motor compartment and the suction region or to the eccentric bearing is present, via which the medium is discharged.

It is advantageous if an intermediate pressure is produced in the motor compartment via the inflow and outflow of the medium.

DRAWINGS

Figure 2:
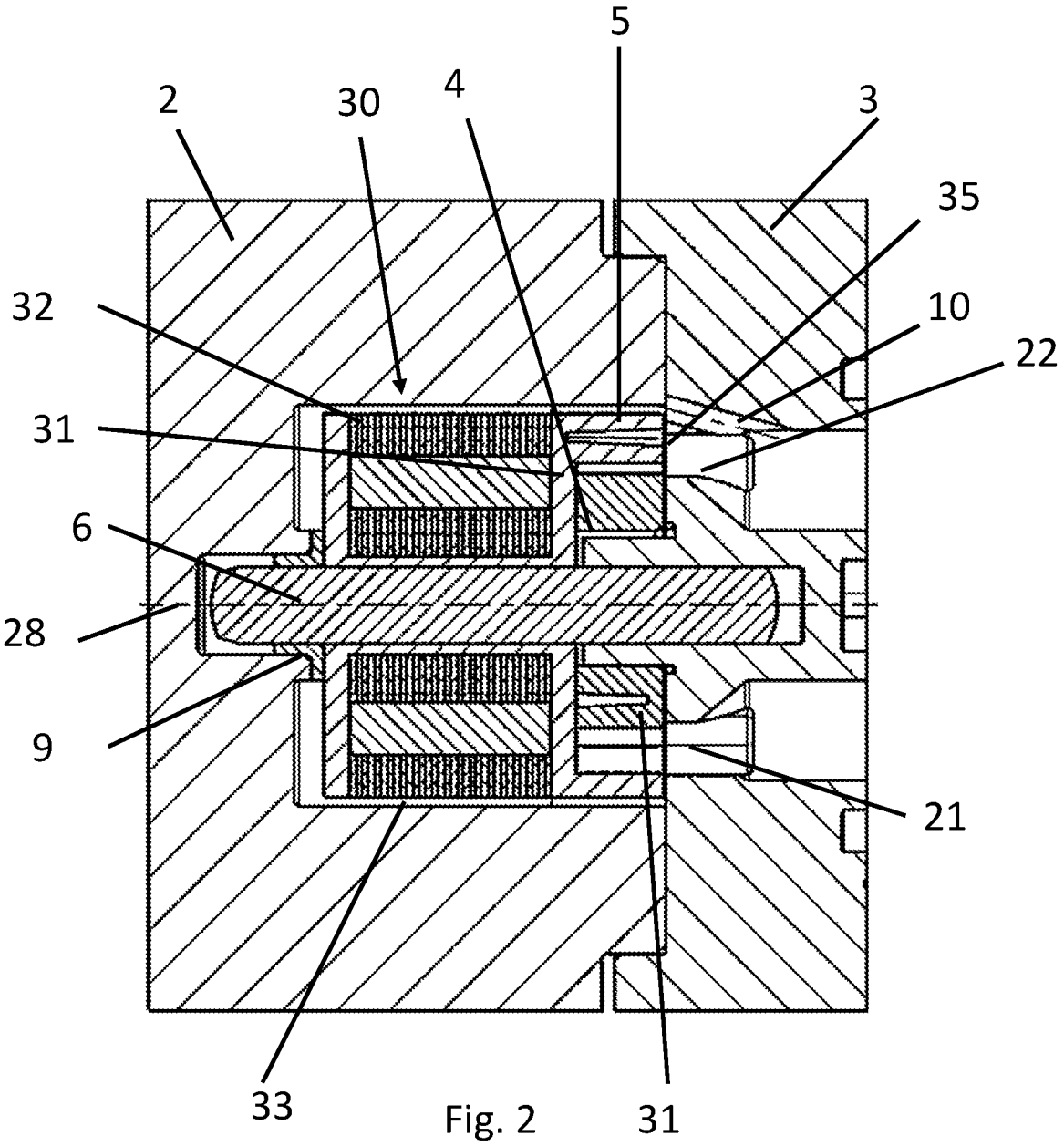
Figure 3:
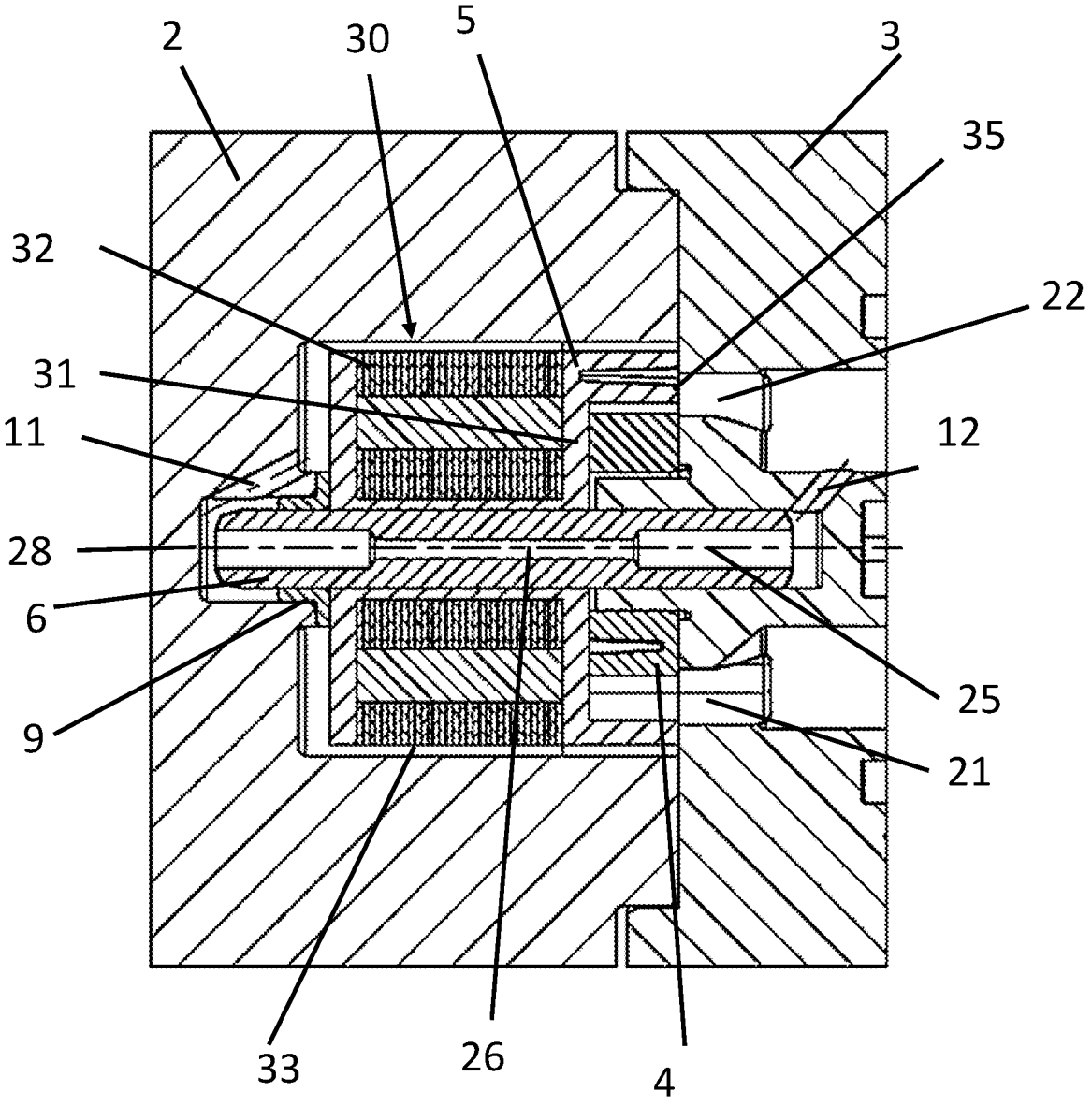
Figure 4:
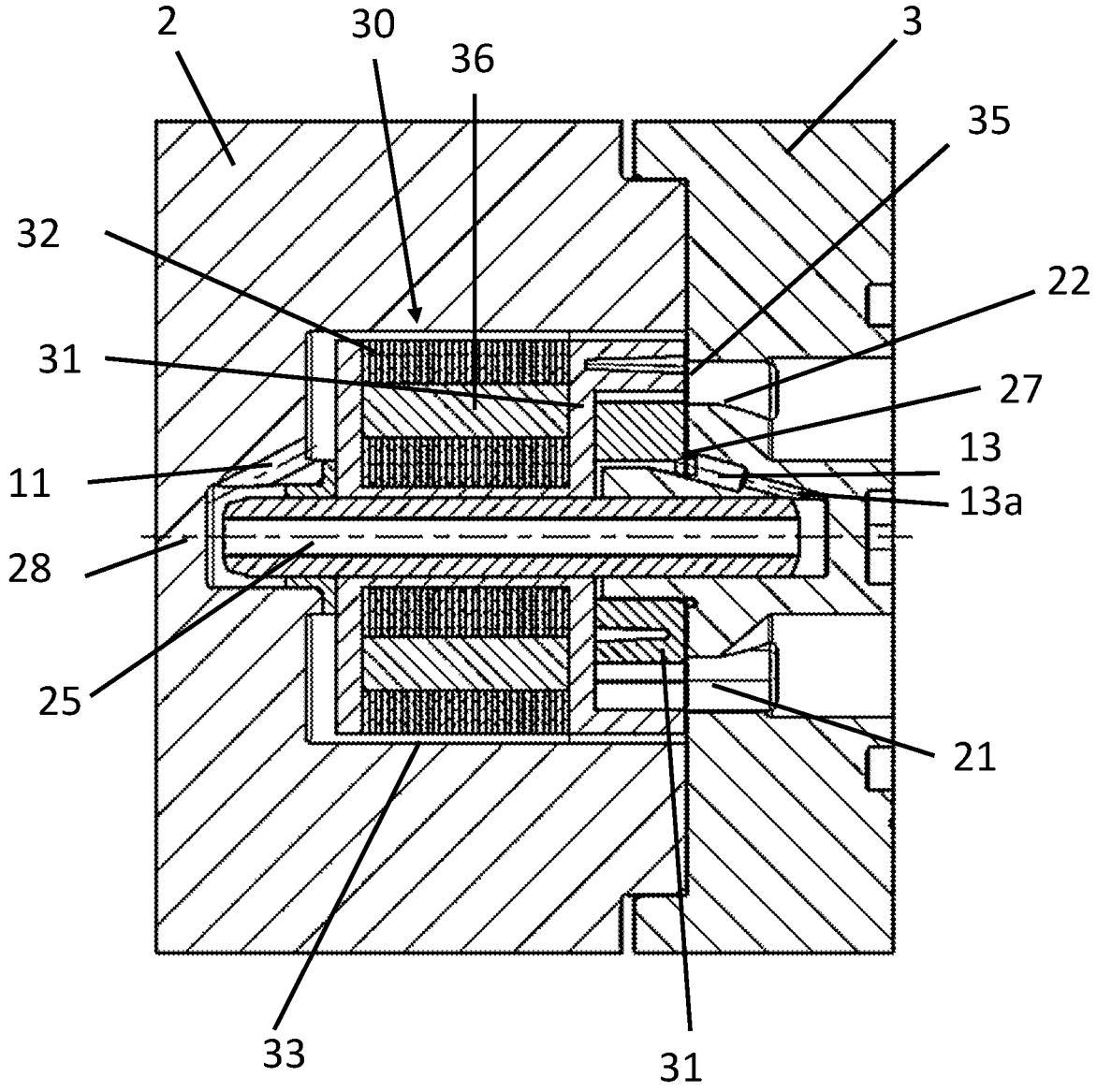
Figure 5:
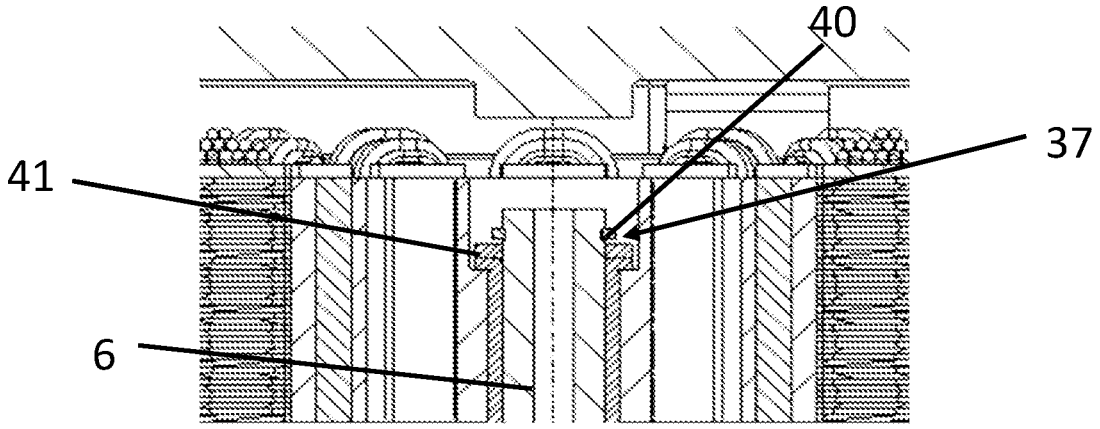
Figure 6:
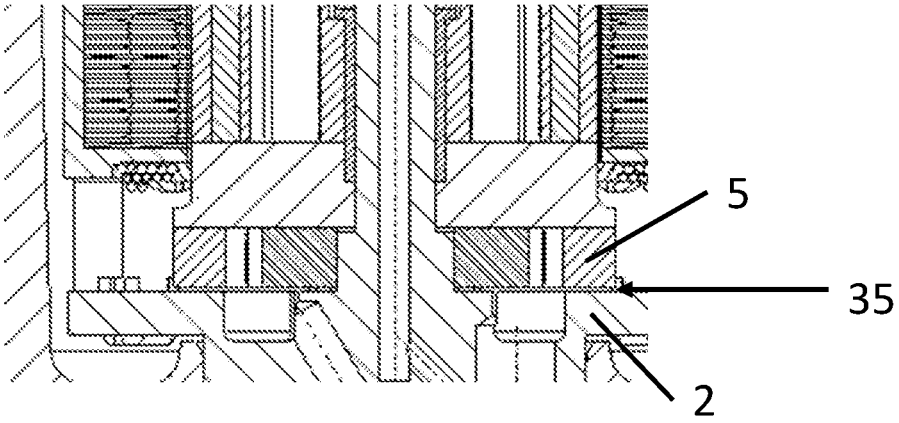

FIG. 1 shows an exploded illustration of the gerotor pump,

FIG. 2 shows a section through a gerotor pump according to the disclosure with bore to the suction region, FIG. 3 shows a section through a gerotor pump according to the disclosure, with shaft bore and throttle cross-section, FIG. 4 shows a section through a gerotor pump according to the disclosure with motor compartment outflow via the bearing of the eccentric for the purposes of improving the lubrication and cooling thereof, FIG. 5 shows a section through a pump according to the disclosure with increased play at the axial bearing of the rotor for the purposes of relieving the pressure compartment of load in the presence of pressure peaks, FIG. 6 shows a section through a pump according to the disclosure with a gap under the rotor for the purposes of relieving the pressure compartment of load in the presence of pressure peaks.

DETAILED DESCRIPTION

FIG. 1 shows, in an exploded illustration, the housing 2, which is closed by means of a flange 3. In the interior, it is possible to see an inner rotor 4 and an outer rotor 5 with a shaft 6. The outer rotor 5 is illustrated separately. Inlet and outlet openings can be seen on the flange 3.

FIGS. 2 to 4 illustrate a gerotor pump 1 with a housing 2 in various sectional views.

In the housing 2, an inner rotor 4 and an outer rotor 5 are rotatably arranged in a pump working compartment of the gerotor pump 1.

In the housing 2, a shaft 6 is mounted rotatably about an axis of rotation 28 by means of a bearing devices 9.

A flange 3 serves as housing cover, by means of which the housing 2, which is of substantially pot-shaped form, is closed off.

An electric motor 30 with a rotor 31 and a stator is integrated into the housing 2 of the gerotor pump 1. The stator comprises a stator laminated core with windings which are embedded together with the stator laminated core into a plastics material. The plastics material is, for example in an injection molding process, shaped so as to constitute the housing 2 of the gerotor pump 1.

The rotor 31 of the electric motor 30 comprises a rotor laminated core 32 and cast-in magnets. The rotor laminated core is, together with the magnets 36, encapsulated with a plastics material. The rotor 31 of the electric motor 30 is integrally connected, by means of the plastics material, to the outer rotor 5 of the gerotor pump 1. Stator and rotor of the electric motor form a motor compartment 33, in which no pressure prevails.

The plastics material thus serves both for realizing the rotor 31 of the electric motor 30 and for realizing the outer rotor 5 of the gerotor pump 1. Thus, the outer rotor 5 of the gerotor pump 1 is directly driven by the rotor 31 of the electric motor 30.

Here, the rotor 31 of the electric motor 30 is mounted, together with the outer rotor 5 of the gerotor pump 1, on the shaft 6 in the housing 2 of the gerotor pump 1. The inner rotor 4 of the gerotor pump 1 is mounted, independently of the outer rotor 5, on an eccentric 6. As a result, the inner rotor 4 of the gerotor pump 1 is arranged eccentrically with respect to the shaft 6 and the outer rotor 5.

The gerotor pump 1 has an suction region 22 in the upper region and has a pressure region 21 in the lower region. The housing cover, the flange 3, is formed from a plastics material or metal.

A connection 10 between the motor compartment 33 of the electric machines 30 and the suction region 22 is arranged in the flange 3.

The motor compartment 33 of the gerotor pump, which is operated by electric motor, is pressurized to an intermediate pressure level, which lies above atmospheric pressure, by means of an inflow of the medium through the gap 35 from the pressure region 21.

By means of a targeted build-up of pressure in the otherwise unpressurized motor compartment 33 of the gerotor pump, the axial bearing 9 is relieved of load, whereby friction losses decrease, and the gap 35 between rotor 5 and flange 3 decreases in size, whereby leakage decreases.

The inflow of the medium into the motor compartment 33 is caused by the leakage in the gap itself. A greater inflow thus gives rise to a higher internal pressure in the motor compartment and thus to an improved sealing action of the rotor 5 against the flange 3, which, in terms of closed-loop control technology, equates to negative feedback.

FIG. 3 shows a further embodiment of the gerotor pump 1.

An inflow of the medium into the motor compartment takes place via the gap 35. By means of a connection 11, the motor compartment 33 is connected to the shaft 6, which has a cavity 25 which extends along the axis 28.

The outflow out of the motor compartment 33 takes place through the cavity 25 into the region of the suction port 7 or a leakage path with a connection 12 directly to the suction region 22.

For the adjustment of the pressure level that results in the motor compartment, a throttle cross-section 26 is provided in the outflow path, that is to say for example in the shaft. The flow through the motor compartment 33 of the gerotor pump, which has come about through a hollow shaft, has the secondary effect that heat losses of electric motor 30 and electronics are dissipated by the flow that is generated, and supply of lubricant a supply to the bearings can be improved.

By relieving an axial bearing in the electric motor of load, the friction of the rotor is minimized, wherein, at the same time, by means of an increase of the contact pressure in a gap between rotor and side wall, the leakage is minimized.

FIG. 4 describes an embodiment which produces a connection 11 between motor compartment 33 and shaft 6 and has a cavity 25 in the shaft 6, which cavity opens out in a connecting bore 13 which produces a connection of the shaft 6 to the eccentric bearing 27. The connecting bore 13 is of reduced diameter and constitutes a throttle 13*a* for the return flow of the medium.

By means of a targeted build-up of pressure in the otherwise unpressurized motor compartment of the pump, the axial bearing is relieved of load, whereby the friction thereof decreases, and the gap between rotor and flange is compressed, whereby leakage decreases. Said intermediate pressure level is high enough to ensure adequate sealing of the pump but permits a load-relieving lift-off of the rotor assembly in the presence of pressure peaks.

The above-described effect of the compensation by internal pressure is based on leakage in the motor compartment of the pump. If only a temporally brief pressure peak arises at the inlet of the pump, the rotor assembly immediately recoils from the pressure plate, because, at the time of arrival of the pressure peak, it has not yet been possible for a pressure of corresponding magnitude to be built up in the motor compartment. To permit such recoiling, it is merely necessary to ensure that the rotor assembly has such amount of axial play that an opening of the pressure compartment is thus permitted, without the rotor assembly being allowed so much play that, in the event of vibrations, without or with low working pressure, destruction can occur owing to impacting against the axial stops, that is to say the axial bearing or the pressure plate.

This requirement is met with a gap 37 that is provided between a retaining ring 40 and a bearing washer 41 on the shaft 6.

The invention claimed is:

1. A gerotor pump comprising:

a housing;

a flange which closes the housing to define a compartment;

an inner rotor;

an outer rotor in driving engagement with the inner rotor, the inner rotor and the outer rotor being positioned within the compartment;

an electric drive positioned within the compartment and including an electric rotor fixed for rotation with the outer rotor, the outer rotor being arranged on a shaft that is supported for rotation within the compartment, a first end of the outer rotor being positioned against the flange, the gerotor pump including a suction region and a pressure region, wherein medium within the pressure region is at a higher pressure than medium within the suction region and the compartment;

a gap between the flange and the inner and outer rotors allowing medium in the pressure region to enter the compartment; and a cavity in the shaft in fluid communication with the suction region and in fluid communication with the compartment.

2. The gerotor pump according to claim 1, wherein the cavity in the shaft has a taper which serves as a throttle.

3. A gerotor pump comprising:

a housing;

a flange which closes the housing to define a compartment;

an inner rotor;

an outer rotor in driving engagement with the inner rotor, the inner rotor and the outer rotor being positioned within the compartment;

an electric drive positioned within the compartment and including an electric rotor fixed for rotation with the outer rotor, the outer rotor being arranged on a shaft that is supported for rotation within the compartment, a first end of the outer rotor being positioned against the flange, the gerotor pump including a suction region and a pressure region, wherein medium within the pressure region is at a higher pressure than medium within the suction region and the compartment;

a gap between the flange and the inner and outer rotors allowing medium in the pressure region to enter the compartment; and a cavity in the shaft in fluid communication with the compartment and in fluid communication with an eccentric bearing of the gerotor pump.

4. The gerotor pump according to claim 3, wherein the cavity in the shaft has a taper which serves as a throttle.

* * * * *